United States Patent [19]

Korte

[11] Patent Number: 4,961,438

[45] Date of Patent: Oct. 9, 1990

[54] SMOKING DEVICE

[75] Inventor: Steven J. Korte, Ramsey, Ind.

[73] Assignee: Brown & Williamson Tobacco Corporation, Louisville, Ky.

[21] Appl. No.: 331,779

[22] Filed: Apr. 3, 1989

[51] Int. Cl.[5] ..... A24B 15/00; A24D 1/18

[52] U.S. Cl. ..... 131/360; 131/364; 131/359; 131/194

[58] Field of Search ..... 131/359, 365, 369, 194, 131/360, 364

[56] References Cited

U.S. PATENT DOCUMENTS 4,732,168 3/1988 Resce et al. ..... 131/359

FOREIGN PATENT DOCUMENTS 0281967 9/1988 European Pat. Off. ..... 131/365

*Primary Examiner*—V. Millin

*Attorney, Agent, or Firm*—Charles G. Lamb

[57] ABSTRACT

A smoking device includes a cylindrical reticulated tube having an open air inlet at one end and an open air outlet at the other end filled with an aerosol generating material. An insulating collar is concentrically located with the reticulated tube covering a portion of the tube and spaced closer to the air outlet end of the tube than to the air inlet end of the tube. A tobacco plug is coaxially located within the tube with the portion of the length of the tube between the collar and air outlet end embedded within the tobacco plug. A nucleating chamber is located at the end of the tobacco plug opposite the insulating collar, and a reticulated wall is located at the interface of the tobacco plug and nucleating chamber. A filter plug is coaxially located with the tobacco plug at the other end of the nucleating chamber. A ribbon of fuel material is spirally wound around the reticulated tube between the air inlet end of the reticulated tube and the insulating collar, and a non-combustible sleeve is concentrically located over at least the spirally wound fuel ribbon.

12 Claims, 1 Drawing Sheet

FIG. 2
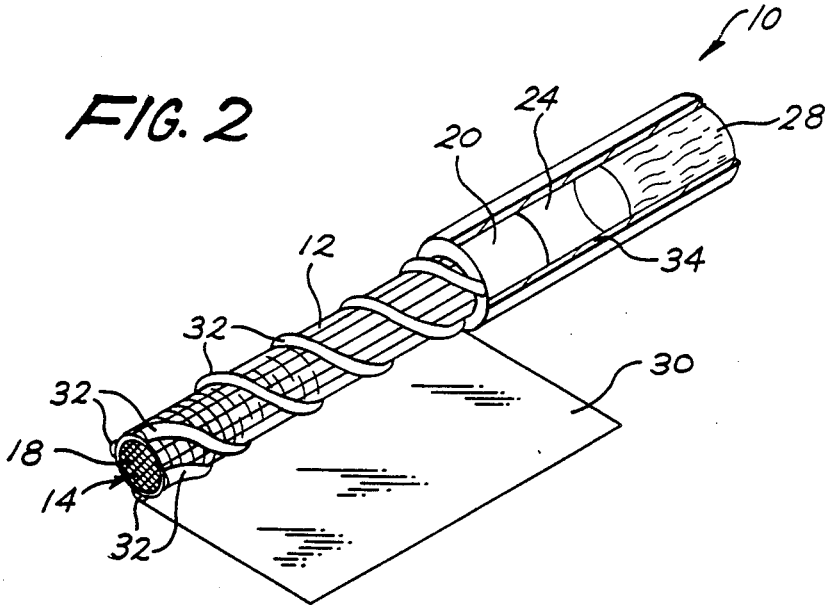
FIG. 3
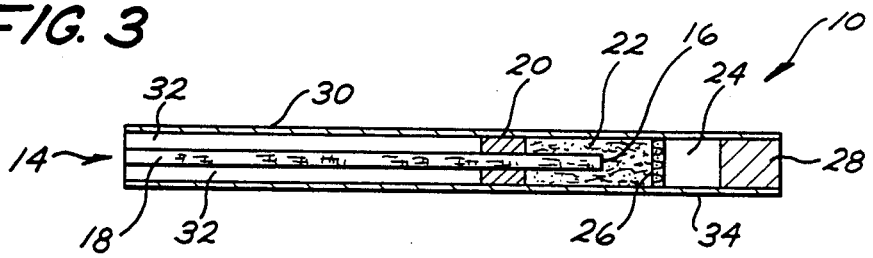
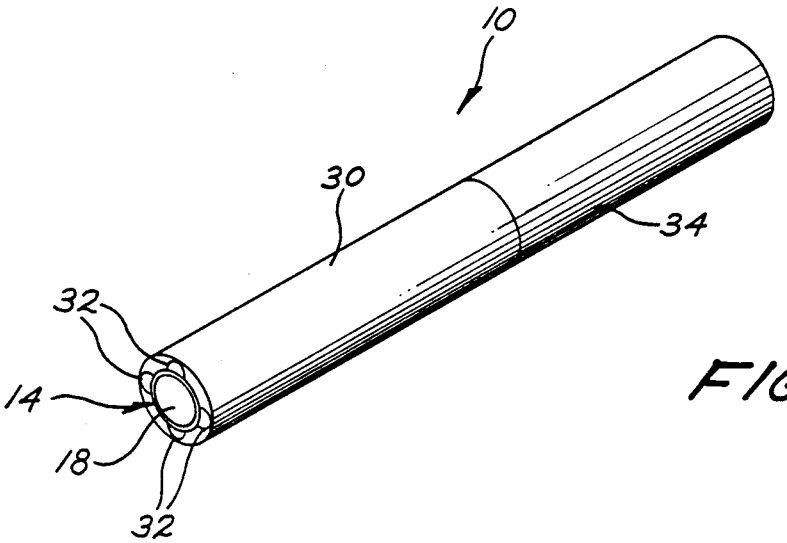
FIG. 1

SMOKING DEVICE

BACKGROUND OF THE INVENTION

1. Field of the Invention

The present invention relates to smoking articles or devices, and, more particularly, to smoking devices which include a fuel element separate from an aerosol generating material with a separate tobacco element which is not burned.

2. Discussion of the Prior Art

Various smoking devices using a central tube and aerosol generating material are per se known.

U.S. Pat. No. 3,258,015 discloses a smoking device having a tubular member concentric in a body portion. The tube member is filled with a nicotine releasing material such as tobacco or tobacco extract, and the body portion surrounding the tubular member is a heating material such as cut tobacco or reconstituted tobacco having good smoldering characteristics. The tubular member is fabricated of a material of high heat conductivity such as copper or aluminum. The heating material communicates with the atmosphere and may be ignited, but it does not communicate with the nicotine releasing material in the tube member. The heat generated by burning of the heating material heats the nicotine releasing composition inside the tube member sufficiently so as to cause the release of nicotine vapor and any aerosol generating material inside of the tube member.

A cooling chamber is located downstream of the tube member for receiving the nicotine vapor and aerosol from the tube member for cooling the nicotine vapor and aerosol. A filter is located at the end of the chamber.

U.S. Pat. No. 3,356,094 discloses a smoking device similar to the smoking device of U.S. Pat. No. 3,258,015. The smoking device includes a cylindrical body with a concentric tube. A condensing chamber is located at the end of the tube. The cylindrical body is finely cut tobacco. The inside surface of the tube is coated with an additive material which is a composition of nicotine or tobacco extract and silica. The tube is frangible and can be fabricated of inorganic salts. The tube can be perforated so that when the device is smoked, smoke from the smoldering tobacco is drawn into the tube where it mixes with air drawn through the tube containing the nicotine and aerosol material. The smoke and nicotine/aerosol bearing air is then drawn into the chamber wherein it is cooled before entering the smoker's mouth.

SUMMARY OF THE INVENTION

The present invention provides a smoking device having a tobacco or other nicotine containing material section which releases flavorants without being ignited.

The present invention further provides a novel fuel section. More particularly, the present invention provides a smoking device comprising a cylindrical tube having a reticulated wall of a non-combustible material having a high heat conductivity, the tube being open at both ends to provide an air inlet at one end and an air outlet at the other end; an aerosol generating material filling the reticulated cylindrical tube, an insulating collar concentrically disposed around a portion of the length of the reticulated tube between the ends of the reticulated tube closer to the air outlet end of the reticulated tube than to the air inlet end of the reticulated tube; a cylindrical body of flavor releasing material axially aligned with the tube and insulating collar with the portion of the reticulated tube between the insulating collar and air outlet end thereof being concentrically disposed in the flavor releasing body and with the air outlet end of the reticulated tube located in the flavor releasing body; a reticulated wall located at the end of the flavor releasing body opposite the end of the flavor releasing body adjacent the insulating collar; a nucleating chamber axially aligned with the flavor releasing body at the other side of the reticulated wall from the flavor releasing body; a filter plug axially aligned with the flavor releasing body and nucleating chamber at the end of the nucleating chamber opposite the reticulated wall; a ribbon of fuel material spirally wound around the exterior of the reticulated tube extending along the length of the reticulated tube from the air inlet end of the reticulated tube to the insulating collar with a space between adjacent turns of the spiral; and, a non-combustible sleeve circumferentially disposed over the spiral wound fuel ribbon from the air inlet opening of the reticulated tube to at least the insulating collar.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 1 is a perspective view of the smoking device of the present invention;

FIG. 2 is a perspective view of the present invention with the wrapper portion unwrapped and partially in cross-section to show internal details; and, FIG. 3 is a longitudinal cross-sectional view of the smoking device as seen in the direction of arrows 3—3 in FIG. 1.

DETAILED DESCRIPTION OF THE PREFERRED EMBODIMENT

With reference to FIGS. 1, 2, and 3, there is shown a smoking device of the present invention, generally denoted as the numeral 10.

The smoking device 10 includes a cylindrical tube 12 having a reticulated wall fabricated of a non-combustible material. The tube 12 is open at both ends to provide an air inlet end 14 one end of the tube 12 and an air outlet end 16 at the other end of the tube 12. The material of the tube 12 preferably has a high coefficient of thermal conductivity. Numerous materials meet the criteria of non-combustibility and high thermal conductivity for tube 12 including, for example, aluminum, copper, alloys thereof, and the like.

An aerosol generating material 18 is disposed within the tube 12. Numerous suitable aerosol generating materials for use in the aerosol generating material are known and include, for example, lipophilic materials such as methyl palmitate, glycerin, lactic acid and the like. The aerosol generating materials are incorporated in a non-combustible substrate which provides for the flow of air therethrough. One such suitable substrate is granular charcoal coated or impregnated with the aerosol generating material 18 which provides for the flow of air through the interstices of the granules.

An insulating collar 20 is concentrically disposed around a portion of the length of the reticulated tube 12 between the tube inlet end and the tube outlet end 16 closer to the tube outlet end 16 than to the tube inlet end 14. The insulating collar 20 can be fabricated of any of a number of materials, which have thermal insulating properties. Suitable materials include, for example, alumina, perlite, magnesium oxide and dual or tertiary mixtures thereof.

A cylindrical body 22 of flavor releasing material 23 is in axial alignment with the reticulated tube 12 and insulating collar 20 with the portion of the reticulated tube 12 between the insulating collar 20 and air outlet end 16 of the tube 12 being surrounded by the flavor releasing material body 22, the air outlet end 16 of the reticulated tube 12 being located within the cylindrical flavor releasing material body 22. The flavor releasing material can be, for example, tobacco, reconstituted tobacco, or a tobacco extract included in a substrate which permits the flow of air therethrough.

A nucleating or cooling chamber 24 is positioned at the end of the cylindrical body 22 in flow communication therewith to receive gas and aerosol therefrom.

A reticulated wall 26 is located across the end of the cylindrical body 22 of flavor releasing material at the interface of the cylindrical body 22 and nucleating chamber 24 to prevent the material in the cylindrical body 22 from entering the nucleating chamber 24 while providing for the flow of gases and aerosol from the cylindrical body 22 into the chamber 24. The size of the openings in the reticulate wall 26 can be selected to provide a pressure drop or draw effort approximately that of a conventional cigarette.

A filter plug 28 is axially aligned with the flavor releasing body 22 and chamber 24 at the end of the nucleating chamber 24 opposite the reticulated wall 26. Filter plug 28 is in flow communication with the nucleating chamber 24 to receive gases and aerosol from the chamber 24 before discharging them into the smoker's mouth. The filter plug 28 can be fabricated of, for example, cellulose acetate, or other filter materials known in the cigarette art.

The insulating collar 20, flavor releasing material cylindrical body 22, chamber 24, and filter plug 26 can be circumferentially enclosed by a non-combustible wrapper 30 such as a paper wrapper treated with burn retardant material.

A ribbon of fuel material 32 is spirally wound around the exterior of the reticulated tube 12 and extends along the length of the tube 12 from the air inlet end 14 of the tube 12 to the insulating collar 20 with a space between adjacent turns of the spiral so that the entire length of the fuel ribbon 32 is in contact with air. As shown, there are four such fuel ribbons 32 spirally wound around the tube 12 with a space between adjacent turns. The fuel material of the ribbon 32 can be any of a wide variety of combustible material. For example, the fuel material can be charcoal, or tobacco, or a combination of charcoal and tobacco, and the like.

A non-combustible wrapper 34 circumferentially surrounds the spirally wound fuel ribbon 32 from the air inlet end 14 of the tube 12 to at least the insulating collar 20. It is contemplated that the non-combustible wrapper 34 can be one and the same as the non-combustible wrapper 30.

As a smoker draws on the filtered end of the smoking device 10, air is drawn both into the space between adjacent turns of the fuel ribbon 32 and into the tube 12 through the air inlet end 14 thereof. The air in the space between the turns of the fuel ribbon 32 supports the smoldering of the fuel ribbon 32 and is in turn itself heated by the combustion of the fuel ribbon. This heated air then passes through the reticulated wall of the tube 12 into the tube 12 wherein it mixes with the cooler air drawn into the tube 12 through the open air inlet tube end 14. At the same time, the smoldering fuel ribbon 32 also heats the wall of the tube 12. Thusly, the heated wall of the reticulated tube 12 as well as the heated air passing through the wall of the reticulated tube 12 heats the aerosol generating material 18 inside the tube 12 causing the aerosol generating material to aerosolize. The aerosol then moves along the tube 12 to that portion of the tube 12 embedded in the flavor releasing material body 22. The aerosol leaves the tube 12 through its reticulated wall and also through the outlet end 16 into the flavor releasing material body 22 wherein the air and aerosol pick up flavorant from the flavor releasing material. The aerosol, flavorant, and air pass from the body 22 and enter the nucleating chamber 24 wherein the air is cooled before passing from the chamber 24 and through the filter plug 28 into the smoker's mouth. The insulating collar 20 functions to minimize the heat transfer from the burning fuel ribbon 32 to the flavor releasing material body 22 and the nucleating chamber 24. Furthermore, on use, the smoker can grasp the smoking device at the location of the insulating collar 20.

The foregoing detailed description is given primarily for clearness of understanding and no unnecessary limitations are to be understood therefrom because modifications will become obvious to those skilled in the art upon reading this disclosure and may be made without departing from the spirit of the invention and scope of the appended claims.

What is claimed is:

1. A smoking device comprising:

a cylindrical tube having a reticulated wall open at both ends to provide a gas inlet at one end and a gas outlet at the other end, the tube being fabricated of a non-combustible heat conducting material;

an aerosol generating material inside the reticulated cylindrical tube;

an insulating collar concentrically disposed around a portion of the length of the reticulated tube between the ends of the reticulated tube;

a cylindrical body of flavor releasing material concentrically surrounding the reticulated tube between the insulating collar and a first one of the ends of tube;

means defining a nucleating chamber axially aligned with the cylindrical body of flavor material immediately adjacent the cylindrical body and open to the cylindrical body; and, a filter plug axially aligned with the chamber at the other end thereof from the cylindrical body;

at least one ribbon of fuel material spirally wound around the exterior wall surface of the reticulated tube extending along the length of the reticulated tube from the gas inlet end of the tube to the insulating collar with a space between adjacent turns of the spirally wound ribbon; and, a non-combustible wrapper circumferentially disposed over the at least one spirally wound fuel ribbon.

2. The smoking device of claim 1, wherein the reticulated tube is open at the second end thereof providing an air inlet end into the reticulated tube.

3. The smoking device of claim 1, wherein the reticulated tube is open at the first end thereof providing an air outlet end from the reticulated tube.

4. The smoking device of claim 1, wherein the length of the reticulated tube between the insulating collar and first end is embedded into the cylindrical body.

5. The smoking device of claim 4, wherein the first end of the reticulated tube is open providing an air outlet end from the reticulated tube.

6. The smoking device of claim 1, wherein the insulating collar is located along the length of the tube closer to the first end of the tube than to the second end of the tube.

7. The smoking device of claim 1, further comprising a reticulated wall located at the end of the cylindrical body interfacing with the nucleating chamber.

8. The smoking device of claim 1, wherein the fuel ribbon comprises non-tobacco fuels.

9. The smoking device of claim 1, wherein the fuel ribbon comprises combustible carbon.

10. The smoking device of claim 1, wherein the cylindrical body further comprises a substrate providing for the flow of air therethrough, and the aerosol generating material is incorporated in the substrate.

11. The smoking device of claim 10, wherein the substrate of the cylindrical body is a non-combustible material.

12. The smoking device of claim 1, wherin the flavorant releasing material includes a tobacco product.

* * * * *